United States Patent [19]

White

[11] 3,961,378

[45] June 8, 1976

[54] CONE CONSTRUCTION FOR LOUDSPEAKER

[76] Inventor: Stanley F. White, 466 E. Vallette, Elmhurst, Ill. 60126

[22] Filed: Nov. 11, 1974

[21] Appl. No.: 522,431

Related U.S. Application Data

[62] Division of Ser. No. 325,162, Jan. 19, 1973, Pat. No. 3,862,376.

[52] U.S. Cl. ..... 29/594; 181/167; 179/115 R; 179/181 R

[51] Int. Cl.[2] ..... H04R 31/00

[58] Field of Search ..... 29/419, 420, 420.5, 29/453, 458, 527.1, 527.3, 594; 179/115 R, 116, 180, 181 R, 181 F, 115.5 R, 115.5 H, 115.5 D, 115.5 U, 115.5 E, 115.5 S; 181/148, 149, 152, 153, 159, 167, 169, 170–174; 116/142 R; 340/388

[56] References Cited

UNITED STATES PATENTS

| | | | |
|---|---|---|---|
| 2,685,935 | 8/1954 | Lenz | 179/115 R |
| 2,905,260 | 9/1959 | Williams | 179/181 F |
| 3,046,362 | 7/1962 | White | 179/115 R |
| 3,292,730 | 12/1966 | Moskow | 181/169 X |
| 3,612,783 | 10/1971 | Schneider | 179/181 F |
| 3,632,703 | 1/1972 | Sullivan et al. | 264/40 |
| 3,708,035 | 1/1973 | Sotome | 181/167 |
| 3,858,680 | 1/1975 | Tsuge et al. | 181/167 X |

*Primary Examiner*—C. W. Lanham
*Assistant Examiner*—Dan C. Crane
*Attorney, Agent, or Firm*—Wolfe, Hubbard, Leydig, Voit & Osann, Ltd.

[57] ABSTRACT

A cone for a loudspeaker in which the shear function is more nearly the same at all radii, the shear function being the product of the effective axial thickness at a given radius multiplied by the circumferential length at such radius. The cone is preferably of curved or "exponential" cross section, deeply angled at a central throat but flattening out to approach a plane at the periphery. The cone is made of light, dimensionally stable material characterized by a high velocity of sonic conduction and is preferably in the form of hollow spheres of glass of small dimension in a binder of epoxy or the like. In an alternate embodiment the cone is made of a hard solid acrylic plastic in thin section and with supporting ribs to provide both rigidity and a substantially constant shear function. Encircling the cone is a flexible hinge or "surround". Interposed between the hinge and the edge of the cone is a light collar having axial rigidity to ensure that the edge of the cone remains in a planar locus. The cone, collar and surround may be made integral with one another in a production line setup. At the center of the cone a stiff cap is provided for closing the central opening and for imparting circular and axial rigidity in the region of attachment of the voice coil.

2 Claims, 18 Drawing Figures

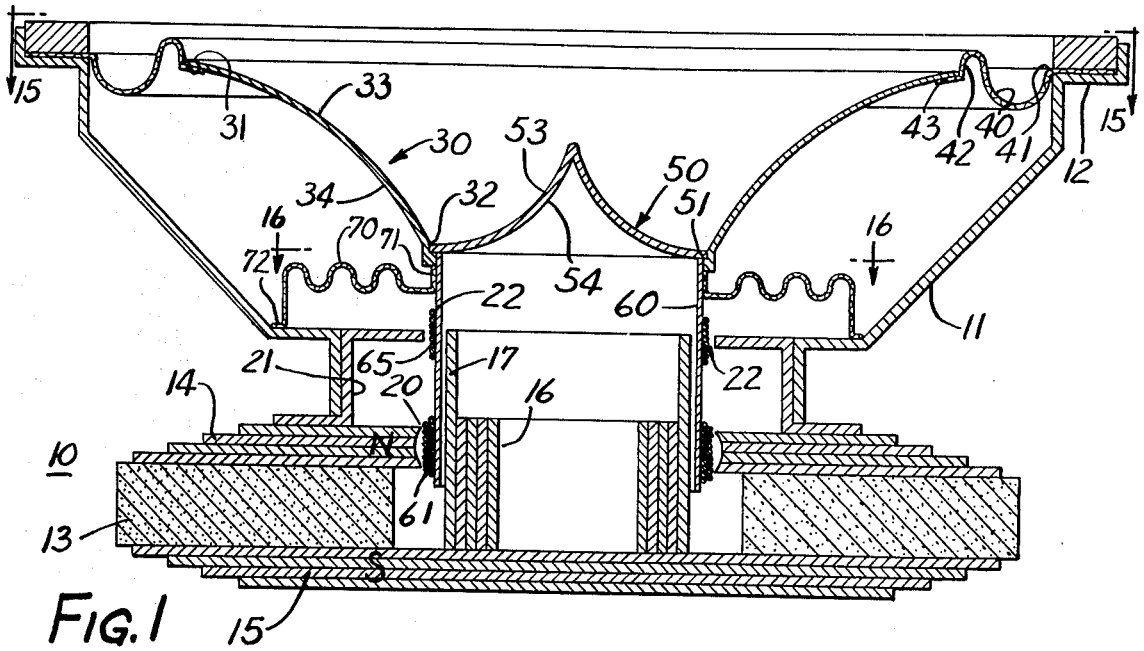
FIG. 1
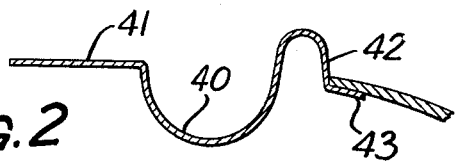
FIG. 2
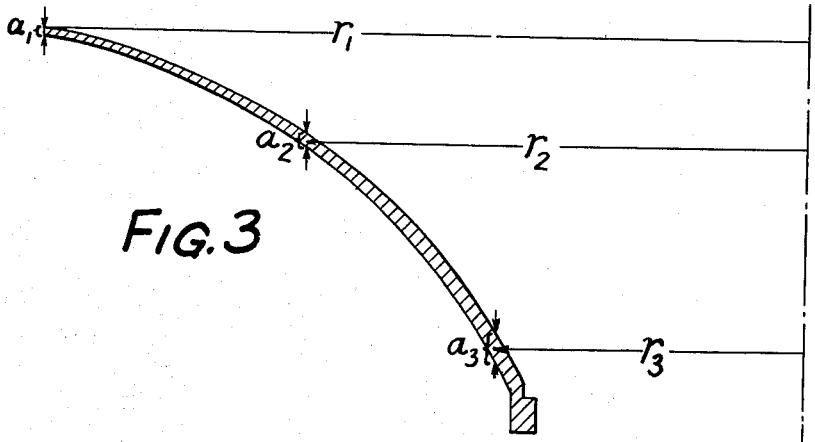
FIG. 3
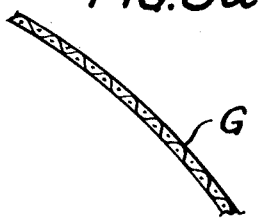
FIG. 5a
FIG. 4
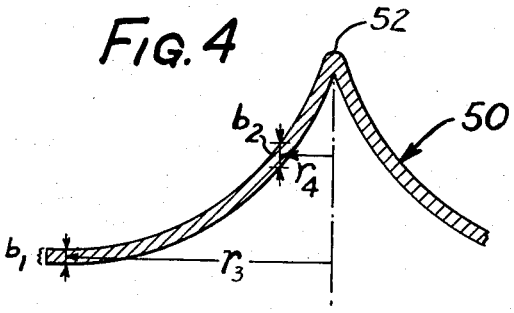
FIG. 5
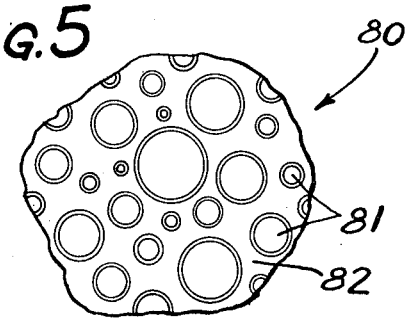

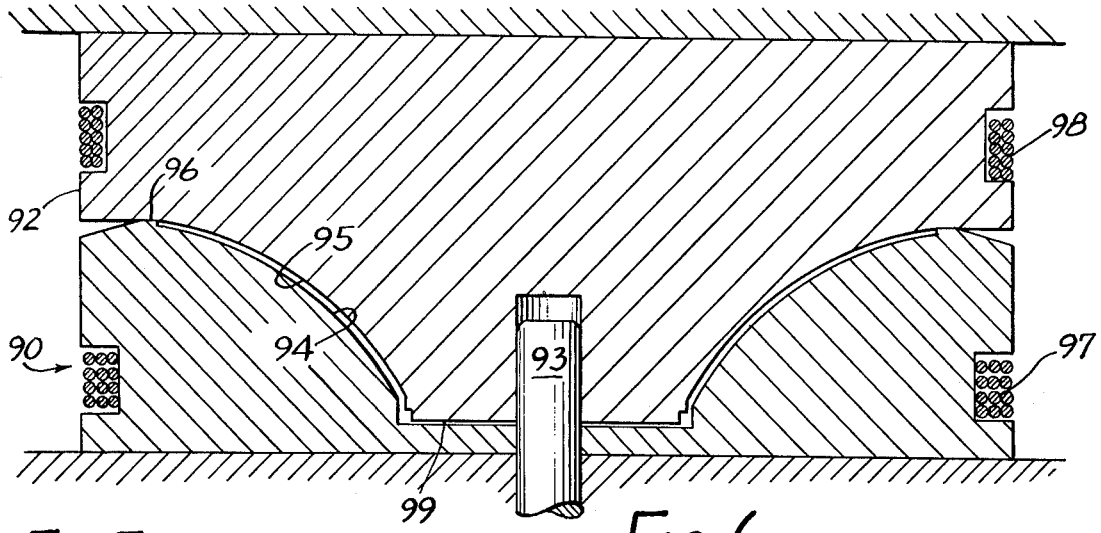
FIG. 6
FIG. 7
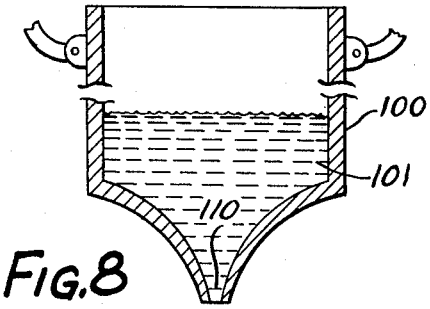
FIG. 8
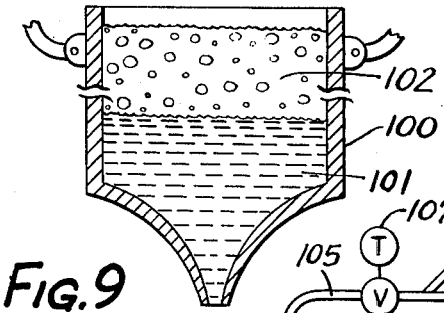
FIG. 9
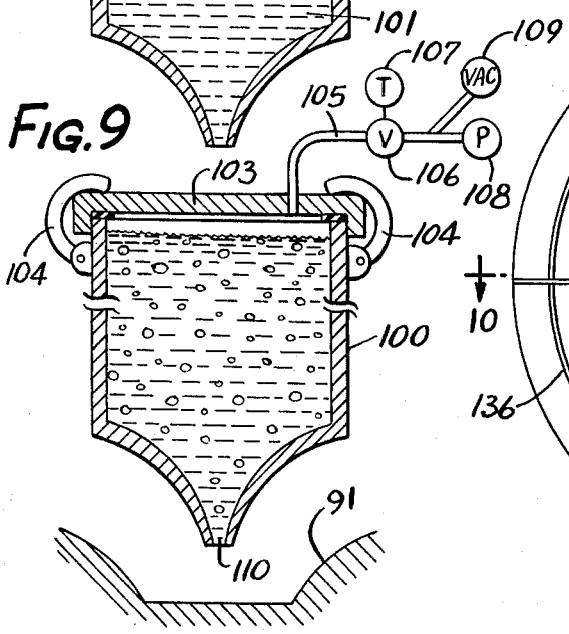
FIG. 10
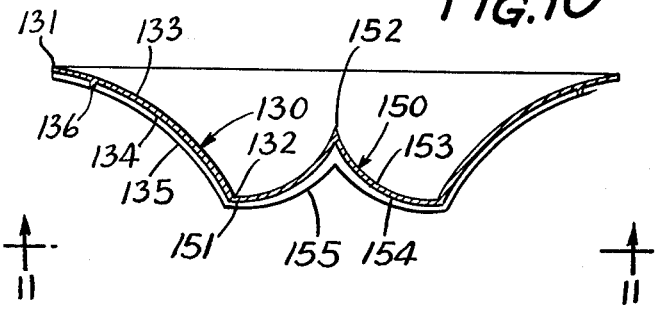
FIG. 11
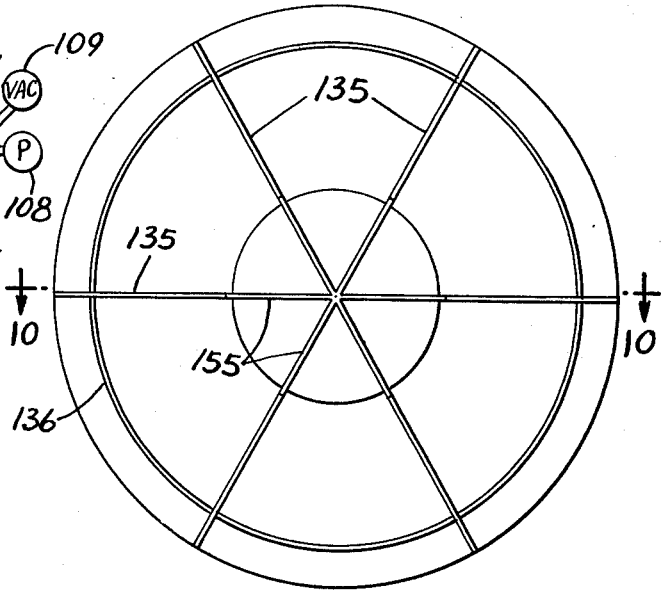

CONE CONSTRUCTION FOR LOUDSPEAKER

This is a division of application Ser. No. 325,162 filed Jan. 19, 1973 now U.S. Pat. No. 3,862,376.

Of all electronic components, loudspeakers have, in the last half century, changed the least. During all of that time a loudspeaker has conventionally employed a cone of paper flexibly mounted at the periphery for axial movement and with a voice coil at the center operating in an annular magnetic air gap. In some respects paper has been a happy choice since is is readily available, cheap and easily worked and since it provides good strength in conical configuration combined with a high degree of dampening which is inherent in its fibrous nature. In the great bulk of loudspeakers which are of small size intended for use in television sets, portable radios and the like, manufacture has been so highly competitive that the designs have been frozen with concentration upon high production techniques and with little effort or expense being devoted to improving th quality of reproduction. Even in the case of speakers of larger size intended for "high fidelity" reproduction, and in which a higher price has financed continued developmental effort, improvement in fidelity has lagged woefully behind the improvement in associated circuit elements such as amplifiers.

Investigation of loudspeakers having paper cones provides ample evidence of inherent drawbacks. Primarily, the cone does not act as a unit or as a true piston in the movement of air. Instead, the cone is subject to "breakup" in which localized areas of the cone vibrate independently. One type of breakup may be descriptively referred to as "Chinese gong" vibration in which the periphery of the cone does not remain in a planar locus but is distorted out of a plane in the form of a sine wave so that adjacent portions of the cone periphery vibrate out of phase with one another. One result of this type of vibration is the deformation of the central portion of the cone out of its normal circular contour into an indeterminant, and transient, eliptical shape.

A second type of localized breakup may be conveniently referred to as "bed-sheet effect" in which the body of the cone departs from its conical geometry and develops traveling waves. Where the waves extend radially the type of localized breakup may be referred to as "plumber's helper" vibration or "oil canning," with the waves being analogous to those set up when a pebble is dropped into a smooth body of water.

The effect of such localized vibration or "breakup" is to produce a response curve which is non-linear and which has peaks and valleys at various points within and beyond the audible range.

Efforts have been made in the past to treat the paper body of a cone to increase its rigidity, to make it waterproof or fire resistant, but such treatments have almost always had the effect of degrading performance. Also efforts have been made to form speaker cones of plastic material but the results have been disappointing or have resulted in an increase in manufacturing cost which cannot be tolerated in such a highly competitive market.

Consequently, it is an object of the present invention to provide a cone for a loudspeaker which avoids use of paper, employing plastic instead, and which overcomes the operating disadvantages of paper cones as well as the operating and cost disadvantages of prior plastic cones. More specifically it is an object to provide an improved cone for a loudspeaker which provides more faithful reproduction at low cost and particularly in sizes of speakers which have not, in the past, been noted for their fidelity and linearity. More specifically, it is an object to provide a cone for a loudspeaker which is substantially free of breakup or localized vibration and which acts, as a unit, over the entire spectrum of reproduction with true piston-like effect.

In this connection it is an object to provide a cone for a loudspeaker which has a substantially constant shear function, that is, one in which the resistance to shearing stress in the axial direction is substantially constant at all radii so that the axial force which is developed in the voice coil is transmitted, in the form of axial shear stress, outwardly to the periphery of the cone with minimum time delay, minimum loss of energy and minimum localized deformation of the cone body. It is a related object to provide a cone having a rigid cap which encloses the central opening and in which the cap, too, has a substantially constant shear function at all radial points.

It is a still further object to provide a cone having such desirable characteristics in either one of two embodiments, a first embodiment in which the cone, which may be smooth surfaced, is formed of an emulsion of small hollow glass spheres, referred to, for example, as "Microballoons," in a plastic binder of epoxy or the like and a second version in which the cone is formed of acrylic plastic or the like in extremely thin section and with integral reinforcing ribs arranged both radially and circularly for the purpose of providing light weight combined with a substantially constant shear function and to act as gates for easy molding capability. In this connection it is a general object to provide a cone in which distribution of the material of construction is optimized to combine the quality of rigidity and lightness.

It is yet another object to provide a speaker cone assembly in which a cone body having a substantially constant shear function is engaged, at its periphery, by flexible surround which may be easily assembled to the periphery of the cone or which may be integrally formed with it, and with the surround being shaped to provide reinforcement of the edge of the cone against the "Chinese gong" type of vibration.

It is a still further object of the present invention to provide a loudspeaker cone assembly in which the surround is of varying width thereby to reduce the likelihood of resonant reflections, back into the cone, from the region of rigid attachment of the surround to the speaker frame.

It is a still another object of the present invention to provide a speaker cone which not only provides improved reproduction but which is well suited to manufacture on high production basis and which is more stable and durable than conventional paper cones. More specifically it is an object to provide a cone which is impervious to extremes of temperature and humidity, presence of radiation, fire, water and other hazards and which is therefore well suited for both military and non-military uses.

It is yet another object of the present invention to provide a cone which enables reproduction with a minimum amount of distortion and with good power handling and sound dispersal characteristics and which may be employed to upgrade the performance of the small, low cost type of speaker usually used in partable radios and TV sets.

Other objectives and advantages of the invention will become apparent upon reading the attached detailed description and upon reference to the drawings in which:

FIG. 1 is an axial section taken through a loudspeaker constructed in accordance with the present invention.

FIG. 2 is a fragmentary enlarged view showing the joint between the cone body and surround.

FIG. 3 is an enlarged axial section taken through one side of the cone body to show the variation in axial thickness as a function of radius.

FIG. 4 is an enlarged axial section taken through the cap showing the variation in axial thickness as a function of radius.

FIG. 5 is a greatly enlarged cross section of a portion of the cone body showing the hollow spheres of glass in a binder of epoxy plastic.

FIG. 5a is a fragmentary section showing the alternative use of glass fabric.

FIG. 6 is a cross sectional view showing a mold for molding the cone body of FIG. 1.

FIGS. 7, 8 an 9 are a series of figures showing the mixing and applying of the glass-epoxy emulsion to the mold in paste form.

FIG. 10 shows a cross section of modified cone body looking along the line 10—10 in FIG. 11.

FIG. 11 shows the appearance of the underside of the cone body looking along the line 11—11 in FIG. 10.

Figure 12:
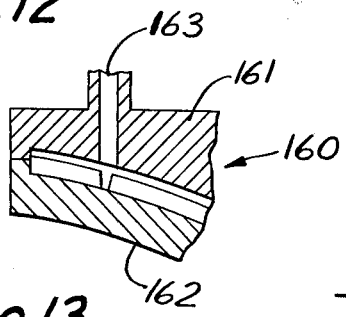

FIG. 12 is a fragmentary section taken through an injection type mold for molding the cone body of FIG. 10.

Figure 13:
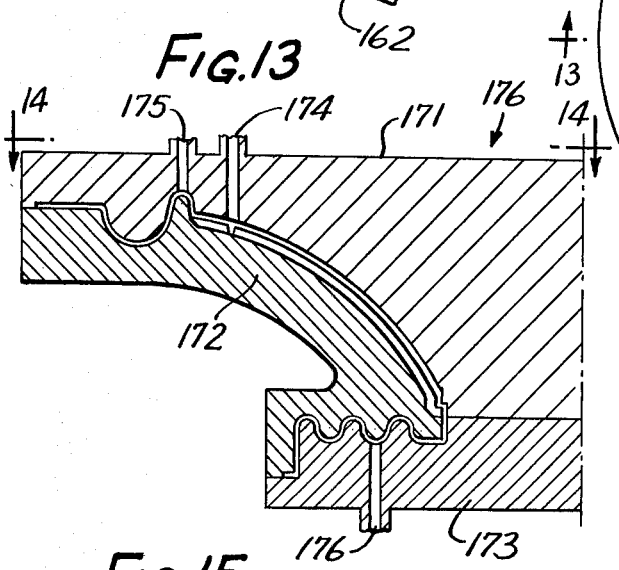
Figure 14:
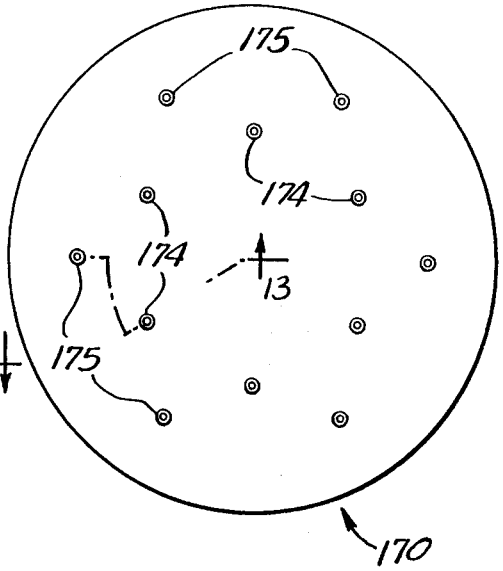

FIG. 13 is a fragmentary section taken through a modified mold for simultaneous injection of hard-curing plastic for the cone body and soft-curing plastic for the surround and spider thereby to produce a cone body having integral flexible mountings, taken along line 13—13 in FIG. 14.

FIG. 14 is a plan view of the mold shown in FIG. 13 and looking along the line 14—14 therein.

Figure 15:
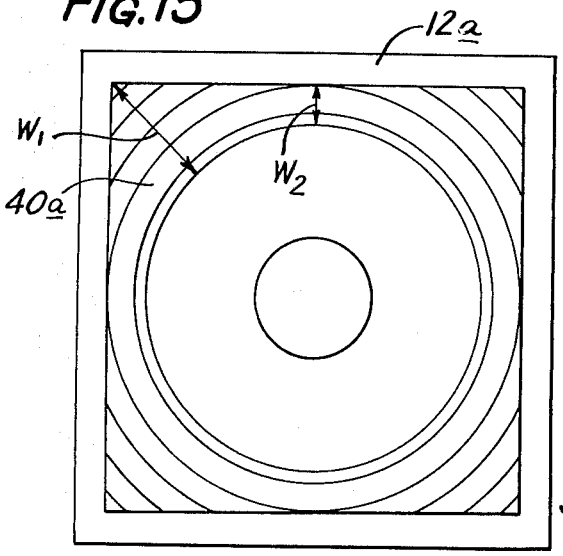

FIG. 15 is a face view, looking along the line 15—15 in FIG. 1, showing a circular cone body in a frame of square configuration to produce a variable width surround.

Figure 16:
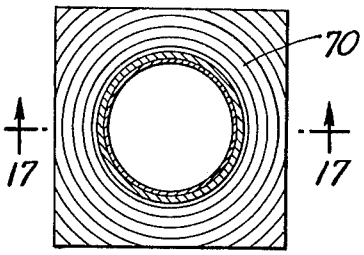

FIG. 16 is a fragmentary section looking along the line 16—16 in FIG. 1 showing a spider of square configuration.

Figure 17:
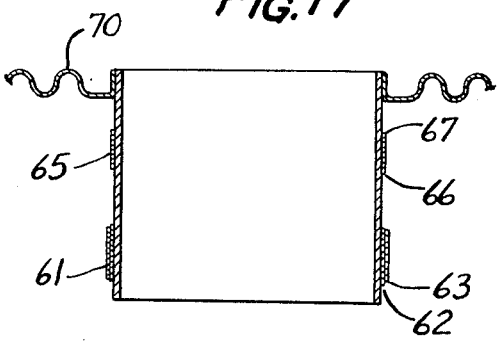

FIG. 17 is a section taken through the spider and looking along the line 17—17 in FIG. 16.

While the invention has been described in connection with certain preferred embodiments, it will be understood that I do not intend to be limited by the embodiments shown but intend, on the contrary, to cover the various alternative and equivalent forms of the invention included within the spirit and scope of the appended claims.

Turning now to FIG. 1 there is shown a loudspeaker 10 having a basket or frame 11 and a mounting flange 12. Secured to the frame is a magnetic structure which consists of a permanent magnet 13, which may be of annular shape, having a pole piece in the form of a first stack of annular laminations 14 on one side and a pole piece formed by a second stack of disc-shaped laminations 15 on the other side. The magnet 13, which may be of the ceramic type employing powdered ferrite is axially polarized so that the stacks of laminations 14, 15 are oppositely poled. Mounted upon the stack of laminations 15 is a central pole piece 16 consisting of a series of concentric laminations, including an outer lamination 17. The stack 14 and outer lamination 17 form, between them, a main annular air gap 20. An auxiliary lamination 21 of Z-shaped cross section cooperates with the edge of the lamination 17 to form a second or auxiliary gap 22 for a purpose which will appear.

In carrying out the present invention a cone body 30 is provided which may be of circular shape having a periphery 31 and throat 32 with an annular convex front surface 33 and back surface 34. Surrounding the periphery 31 of the cone body is a flexible surround 40, which may in its simplest aspect be annular, having an outer edge 41 and an inner edge having a portion 42 which meets the periphery of the cone body at right angles and forming an axially facing internal ledge, or shoulder, 43 into which the periphery of the cone body may be forcibly snapped and cemented in position. The right-angular relationship serves to reinforce the presented edge of the cone. Alternatively, the collar may be integral with the surround. The surround 40 may be made of flexible material impervious to air, for example, butyl rubber, or of cloth impregnated with a resilient plastic such as a phenolic resin. Or tightly woven cloth without impregnation may be used.

In accordance with the present invention the cone body 30, as shown in FIG. 4, has an effective axial thickness which varies generally inversely with the radius thereby to provide a substantially constant shear function. More specifically in accordance with the invention the cone body is curved, preferably in accordance with an exponential function so that the surface angles sharply inwardly at the throat and approaches a plane at the periphery. Thus, referring to FIG. 4, the effective axial thickness at a radius $r1$ is indicated by the distance a1. Because of the curvature the effective axial thickness at the lesser radius $r2$ is increased to an amount a2 which is greater than a1. Taking this a step further, the effective axial thickness at the radius $r3$ is an amount a3 which is a maximum. Thus, even though the cone body may be of constant thickness, normal to the surface, the thickness in the axial direction is not constant but varies as an inverse function of the radius, being a minimum in regions of large radius and a maximum at the throat where the radius is small.

This inverse relationship tends to produce a shear transmitting capability which remains substantially constant for all radii. The shear function, which may be denoted by the letter U denotes the product of the axial thickness multiplied by the circumferential dimension at the particular radius. The circumferential dimension for a given radius is the radius multiplied by $2\pi$. Thus, in the illustrated embodiment, the axial thickness is such that the following quantities are approximately equal:

$$a_1 2\pi r_1 \overset{a}{=} a_2 2\pi r_2 \overset{a}{=} a_3 2\pi r_3$$

In carrying out the invention the three quantities need not be precisely equal to one another; it suffices that they generally approximate one another to signify optimum usage of material, which is to be contrasted with conventional loudspeakers where the shear capability varies widely from the periphery of the speaker body to the throat.

Further in accordance with the present invention a rigid cap is provided to enclose the throat, the cap having an axial thickness which is greater toward the center than toward its periphery thereby tending to more nearly equalize the shear function within the cap. Thus, referring to FIGS. 1, 3 and 4, the cap indicated at 50 has a periphery 51 and a center 52 with a front surface 53 and a rear surface 54, the cap being preferably so shaped as to provide a convex annular surface 53 terminating at an upraised point at the center. As shown in FIG. 4, the cap has an axial thickness b1 at the radius r3 and a greater thickness b2 at the lesser radius r4, the thickness thus varying approximately inversely with the radius as in the case of the cone body. The result is to produce a shear function which remains more nearly constant over the radius of the cap than would be the case, say, if the cap were formed in shallow dome shape as is more conventional.

The periphery 51 of the cap seats in the throat 32 of the cone body. Inserted into the throat, and suitably cemented therein, is a voice coil form 60 of cylindrical shape having a main winding 61 which extends into the main annular air gap 20, with terminals 62, 63, as well as an auxiliary winding 65, having terminals 66, 67, the latter winding being positioned in the auxiliary annular air gap 22. The winding 61 may be conventional or it may be of flat-wound ribbon for improved efficiency and heat transfer. The purpose of the auxiliary winding 65 is to produce a motional negative feedback signal as is discussed in greater detail in the co-pending application mentioned above. For the purpose of guiding the coils in the air gaps with pure axial motion, a spider 70 is provided which is formed of flexible material having an inner edge 71 which engages, and supports, the throat portion 32 of the cone body as well as a flange portion 72 which seats upon the speaker frame. The spider may be formed of the same material as the surround 40.

In accordance with one of the aspects of the present invention the cone body 30 is formed of hollow spheres or balloons of glass bound in a plastic having the wetting and other characteristics of epoxy. More specifically in accordance with the present invention an epoxy plastic, with hardener added, and heated to a flowable, vixcous consistency, is mixed with the glass balloons in such a way as to insure complete wetting with a minimum amount of epoxy and with reduced likelihood of air voids. The epoxy-glass mix is then discharged into a mold, the mold is closed to define a cone of desired shape, and any excess mix is expressed in the form of "flash". Heat is then applied to the mold to cure or harden the mix, following which the mold is opened to remove the cone which, upon removal of the flash, is ready for mounting within the surround and spider. The net result is to produce a uniform cellular structure 80 as shown in FIG. 5 consisting of closely spaced balloons 81 held together with a plastic binder 82, the mix being homogeneous, extremely strong, smoothly surfaced and with a uniform density on the order of 0.9, or lower, depending upon the size and wall thickness of the balloons and the amount of plastic required for wetting.

Referring to FIG. 6 there is shown a simplified mold of a type which may be used in practicing the invention. FIGS. 7, 8 and 9 diagrammatically illustrate the manner in which the epoxy and glass balloons are brought together and applied to the mold in measured quantity.

The mold, indicated at 90, is of two-piece construction made up of a lower mold section 91, and an upper mold section 92 which are keyed together by a pin 93. The mold cavity is formed by the facing surfaces 94, 95 with final closure being determined by an annular stop surface 96. The surfaces 94, 95 are preferably surfaced with a parting agent such as silicone or tetraflouroethylene (teflon). The unit may be heated by electric heating coils 97, 98, with the lower section preferably kept at a cooler temperature to prevent premature setting when the mix is poured into the lower section and until the mold is closed. In a production setup the sections 91, 92 may be hydraulically opened and closed.

In mixing the epoxy and glass balloons, the epoxy with hardener added, is deposited in measured quantity in a dispenser 100, the body of epoxy being indicated at 101. A typical epoxy plastic which may be used for this purpose is chemically identified as a cyclo-aliphatic resin. A hardener which is chemically n-phenolene-diamine is commercially obtainable from Union Carbide Corporation, New York, N.Y. Reference is made to the literature for additional information on epoxy plastics. It will be understood that any of the commonly available epoxies and hardeners capable of wetting glass, of flowable consistency, and having an appropriate hardening time may be used. It is preferred to choose an epoxy and hardener combination which, upon slight heating, to 120° F will have a viscosity which does not exceed 200 centipoises.

The glass balloons preferably have a diameter which may range from $10u$ to $500u$ with a wall thickness of about $2.0u$. Such balloons are obtainable commercially from Emerson and Cummings, Inc. whose address is Canton, Mass., identified as their catalog 915-RU-30n 7-69. The balloons are also commercially available from 3M Company whose address is St. Paul, Minnesota. The balloons should preferably be formed of glass of hard composition, such as "flint", "crown" or "crystal" glass.

A body of glass balloons 102 is deposited above the epoxy as shown in FIG. 8. The epoxy is drawn by capillary attraction between the glass balloons until all have been wetted and absorbed into the body forming a viscous yet slightly "pastey" consistency. For discharging the mix from the vessel, a cover 103 is applied secured by clamps 104 and connected to an air line 105 having a valve 106 and time 107. The valve 106 is connected to a source of pressure 108 as well as a separately operable vacuum pump 109. Air is first purged from the mix by operating the vacuum pump. Following this, pressure from the source 108 is admitted by timed opening of the valve 106. Using calibrated amounts of epoxy and glass heated to a calibrated temperature and using a calibrated orifice 110, which may be on the order of 1/8 inch diameter, a measured amount of mix is deposited upon the lower die member 91. The upper die member 92 is then seated (FIG. 6) with any excess mix escaping as flash, following which the mold is heated to a sufficient temperature and for a sufficient time, to produce "kick-over". The mold shown in FIG. 6 is by way of example only and an automated mold of commercially available design may be employed in a high production setup with inducation heating and an automatically controlled temperature cycle. Moreover, an epoxy and hardener may be chosen which produce "kick-over" as rapidly as the state of the art permits. The cap 50 may be made of the same material as the cone body formed in a similar mold having a cavity of cap shape.

After removal of the molding flash, and after stooping out the central annulus portion, indicated at 99, with a suitable set of dies, the cone may be pressed, and cemented in seated position within the surround 40 and the voice coil support 60 may be cemented in place in the central opening (see FIGS. 2 and 3). The cap 50 may, however, be omitted until a final assembly step in order to provide access for insertion of a centering shim, of paper or the like, around the pole lamination 17 (see FIG. 1) to insure entering of the coils 61, 65 in their respective magnetic gaps.

As a further aspect of the present invention the glass, instead of being present in the cone body 30 (FIG. 1) in the form of balloons, (as shown in FIG. 5) may be present in the form of reinforcing glass cloth or roving G, as illustrated in FIG. 5a. The cloth in a practical case may be quite thin having a thickness of 2 to 4 mils, while the cone has a thickness of 5 mils. The glass cloth G may be placed in the mold manually and the dispenser 100 may be used, as described, to dispense the epoxy.

Tests made upon a loudspeaker employing a cone utilizing glass balloons or glass cloth bound with epoxy as described above, show that fidelity of reproduction is obtainable in various known types of cabinets which is far beyond that obtainable using speakers with conventional cones made of paper. The cone, utilizing a constant shear function and of stiff, light construction operates without breakup in the audible range and with true piston-like action. Utilizing "strobe" lighting and other test facilities it is found that a speaker employing the improved cone is capable of operating at high power levels over, and substantially beyond, the audible range without localized breakup of the type above identified as "Chinese gong" effect in which the outer edge of the cone is distorted into a sine wave configuration. That is particularly attributed to the unusual edge stiffness resulting from the structural characteristics of the glass balloons. Use of balloons which are perfectly spherical is found to produce better results than where the cells are faceted as is the case in connection with plastic expanded, closed cell films of various kinds.

It is also believed that suppression of "Chinese gong" vibration is assisted by use of the rigid circular cap 50 which is intimately cemented to the throat of the cone and which insures that the throat of the cone will remain perfectly circular at all times. One effect, not widely recognized, of the Chinese gong type vibration is that it tends to deform the throat of the cone from a true circle into eliptical configuration, at least at certain frequencies. By using a cap of rigid construction the reinforcing effect is felt all the way out to the edge of the cone. The separate effect known as oil-canning is also overcome by the present cone construction.

A further explanation of the response achieved by the present speaker design may be found in the high velocity of sound propagation in the cone body and the attenuation of reflections of the sound from the periphery of the cone assembly back to the voice coil. Using present procedures the velocity of propagation in the cone body is on the order of four times the velocity of propagation in conventionally used paper. In speakers employing conventional cones and surrounds, the wave which is transmitted within the body of the cone passes radially, more or less freely, until the region of anchoring of the surround is reached which provides an abrupt change in impedance, resulting in a reflection of the wave back into the cone where phase differences and resonances encourage the setting up of localized vibration. Using the present cone with a high velocity of transmission, any reflected wave resulting in resonance causes resonance to occur well outside of the audible range. The net effect of the foregoing is to produce a response curve which is remarkably linear, that is, substantially free of the peaks and valleys which are encountered, and taken as a matter of course, in conventional designs of speakers.

It is found, too, that cone-air coupling is remarkably efficient and that the off-axis dispersion characteristic is improved compared to that of conventional speakers. It is believed that this is due to the fact that the cone, free of localized breakup, acts as a single source with piston action, plus the combination of the convexly arcuate, annular surface 33 of the cone body and the concavely arcuate annular surface 53 of the cap. Indeed, more reliance is placed upon the cap 50 as a transducer than is the case of speakers of conventional design. The cap because of its shape and rigidity exhibits a high degree of stiffness with no possibility of breakup even at the highest frequencies which it may be called upon to reproduce.

It is found that a speaker constructed as described above, and mounted in an appropriate cabinet, is not only capable of high fidelity reproduction with small speaker size but is capable of providing improved reproduction when mounted in less-than-optimum enclosures as, for example, encountered in portable radios and television sets where the speakers used in the past have generally been of poor quality. Moreover, speakers of the present design are ideally suited for applications requiring waterproofness and fireproofness. The epoxy-glass mix is inherently waterproof so that the speaker is ideal for outdoor usage, either for music reproduction or for paging purposes. The inherent fireproofness of the cone material, as contrasted with paper, makes it possible to use speakers of the present design in military apparatus or in other equipment where flammability is considered a possible hazard. The surround and spider may be made of any suitable materials which possess the desired waterproofness and fire resistance as well as providing the necessary flexibility over a wide temperature range.

The above paragraphs have been directed toward the description of a preferred embodiment of speaker. The invention in certain of its aspects, however, is not limited to use of the particular cone material and the constant shear characteristic may, if desired, be obtained in a cone which employs a hard, dimensionally stable and relatively dense plastic but which is molded in extremely thin section with appropriate integral ribbing to provide the necessary rigidity for pistonlike action. An alternate form of cone body is set forth in FIGS. 10 and 11 which show the cone body which may be conveniently made of a high quality acrylic plastic which is moldable under pressure in thin section, with the flow of the molten plastic being facilitated by a radial and circular pattern of ribbing. Turning to FIG. 10 a cone body 130 is shown having a periphery 131 and a throat 132 and with a front surface 133 and a rear surface 134. Integrally molded in the rear surface of the cone body are a series of radial ribs 135 which may, for example, be six in number and which are interconnected by a circular rib 136. In a typical case where acrylic plastic is used having a density of approximately 1.2 it may be molded in a thickness of 0.012 inch with ribs having a width on the order of 0.030 inch. The ribs are made of such height as to produce a substantially constant shear characteristic at various radii within the body. It will be recalled in connection with FIG. 4 that determination of the area in axial shear at any given radius was a simple matter of multiplying the axial thickness times the radius multiplied by a constant 2, such product being generally constant at all radii. The same is true of the structure shown in FIG. 10. except that the axial cross sectional area of all of the ribs at the particular radius must be added to the axial cross section area of the portions between the ribs. It is desirable, in any event, for the ribs to so proportioned that the shear characteristic is substantially constant for all radii except, of course, for the circular rib or ribs which define regions of maximum shear resistance.

The cap 150, which is centered within the throat is of similar construction, having a periphery 151, a central point 152, a front surface 153, rear surface 154 and radial ribs 155.

In the case of the embodiment shown in FIGS. 10 and 11, attachment to the surround and to the voice coil form and spider are made substantially the same way as shown in FIGS. 1–3. The rib 136 is located at a sufficient radius, i.e., sufficiently close to the periphery, so that the rib assists in suppressing any tendency toward Chinese gong vibration.

The use of acrylic plastic is preferred for the embodiments of FIGS. 10 and 11 of its extreme hardness and because of the high velocity of conducted sound, both of these factors being enhanced as a result of the molding process. Such a plastic is commercially available under the trademark PLEXIGLAS from Rohm and Haas Chemical Co. whose address is Independence Mall, Philadelphia, Pa. However, chemically different plastics having similar physical and molding characteristics are usable as, for example, polycarbonates. Such plastics are available commercially from General Electric Company, New York, N.Y. identified, for example, as "LEXAN 500".

Because of the extreme thinness of section it is not possible to employ a mold of the type illustrated in FIG. 6. Instead it is necessary to use an injection type mold having a cavity corresponding to the shape of the final product and into which the molten plastic is injected, at one or more points, under high pressure and at a relatively high temperature. Injection molding machines capable of producing the cone body described in connection with FIGS. 10 and 11 are readily available manufactured by Cincinnati Company whose address is Cincinnati, Ohio or the Arburg Company of Germany whose local address is Chicago, Ill. During the injection process the radial and peripheral ribs are utilized to insure equalized distribution of the viscous plastic. FIG. 12 illustrates fragmentarily an injection type mold 160 having an upper member 161 and a lower member 162 and with an inlet orifice 163 at a junction between a radial rib 135 and the circular rib 136, one orifice being used at each rib junction, making a total of six. The plastic injected under pressure into the orifices flows through the rib channels which act as gates for the feeding and spreading of the viscous plastic throughout the structure, thereby assuring the molding of a complete cone body, notwithstanding the thin section.

It is one of the features of the present invention that the flexible surround and flexible spider may be integrally molded with the stiff cone as part of the same molding operation. This involves use of a socalled dual-injection mold as shown at 170 in FIG. 13, the mold being made up of an upper section 171, a central section 172, and a lower section 173. In addition to a series of inlet orifices 174 which inject "hard-cure" plastic, there is a separate set of injection orifices 175 which inject "soft-cure" plastic for the surround and a third set of injection orifices 176 which inject "soft-cure" plastic for the spider. The viscosity pressure and orifice size may be adjusted so as to produce an integral joint between the hard and flexible portions of the cone assembly. An injection molding press capable of such dual injection is manufactured by the Arburg Company mentioned above.

As an alternative to simultaneous injection, a cone body 130 such as shown in FIGS. 10 and 11 may be pre-molded and interposed in position in a mold such as that shown at 170 in FIGS. 13, following which soft-cure plastic may be injected through orifices 175, 176 to provide the integrally-jointed surround and spider.

It is one of the still further features of the present invention that the mounting flange 12 of the frame or basket 11 of the speaker shown in FIG. 1 need not be circular or provide a surround of constant width. On the contrary, the mounting flange may be of square or rectangular cross section as shown at 12a in FIG. 15 with the surround, indicated at 40*a*, having a width which varies, being a maximum w1 at the corner positions and a minimum w2 at the side portions. Similarly, the spider 70 need not be round but may be of square configuration as shown in FIG. 16 to provide a variable spider radius. In both cases the effect of the variable radius is to avoid resonance effects due to reflections within the surround or spider which might produce a peak or a valley in the response curve.

It is a still further feature of the invention that the leads 62, 63 from the voice coil 61, instead of being provided as loose pigtails, may be integrally molded or woven in the spider as shown in FIGS. 17, the same being true of the leads 66, 67 from the auxiliary coil 65. Moreover, while the main and auxiliary coils 61, 65 may be close wound of conventional wire, it is possible to make them flat wound employing ribbon, for example, a thin ribbon of aluminum on the order of 0.0015 inch in thickness and 0.5 inch in width with adjacent convolutions insulated by anodization of the aluminum to a thickness on the order of 0.0001 inch and the further additional insulation value of the bonding glue.

In the following claims the term "exponential" is applied to the cone body 30 to define its curvature. This term is a general one to denote a curve which produces a smooth variation from periphery to throat and which causes the surface of the cone to project axially inward of the throat while approaching a plane at the periphery. The exact value of the exponent is not critical if this condition is met. However, it is preferred to utilize a surface in which the exponent lies within the range of 2 to 4. Nor need the curve be rigorously exponential in shape since a hyperbolic curve, or even a circular or eliptical section falls sufficiently close to an exponential curve as to bring about the desired result, provided that the axial section, including rib cross section, at each radius, is maintained substantially constant as discussed.

What I claim is:

1. The method of making a loudspeaker cone assembly which comprises combining hollow spheres of glass of microscopic dimension with a mixture of an epoxy plastic and hardener in the liquid state to form a pastey emulsion free of voids, placing the emulsion in an open mold cavity, closing the mold cavity to form the emulsion into the shape of a cone having a periphery and a central throat, applying heat to harden the cone, reopening the mold cavity and removing the cone there-from, affixing a flexible surround to the periphery and a flexible spider to the throat, and mounting a voice coil axially at the throat.

2. The method of making a loudspeaker cone body which comprises providing a pair of cooperating mold sections defining a cone-shaped cavity of thin cross section with a continuously smooth and uninterrupted front surface and a back surface having radial and circular axially-extending grooves to form integral ribs, injecting moldten plastic into the cavity so that the plastic is conducted via the grooves into all portions of the cavity so that the cavity is completely occupied by the molten plastic, and then cooling the plastic in the cavity to form a solid plastic cone body.

* * * * *